United States Patent [19]

Fukunaga et al.

[11] Patent Number: 4,642,980

[45] Date of Patent: Feb. 17, 1987

[54] TENSION DEVICE FOR USE IN TWO-FOR-ONE TWISTER

[75] Inventors: Mitsuo Fukunaga, Kyoto; Yoshihisa Inoue, Ibaragi, both of Japan

[73] Assignee: Murata Kikai Kabushiki Kaisha, Japan

[21] Appl. No.: 870,287

[22] Filed: May 21, 1986

Related U.S. Application Data

[63] Continuation of Ser. No. 565,928, Dec. 27, 1983, abandoned.

[30] Foreign Application Priority Data

Dec. 28, 1982 [JP] Japan ..... 57-198102[U]

[51] Int. Cl.[4] ..... D01H 7/86; D01H 13/10; D01H 1/40; B65H 59/22

[52] U.S. Cl. ..... 57/58.86; 57/58.83; 57/279; 242/147 R; 242/149; 242/152.1

[58] Field of Search ..... 57/58.49, 58.7, 58.83–58.86, 57/279, 280; 242/147 R, 149, 152.1

[56] References Cited

U.S. PATENT DOCUMENTS

| | | | |
|---|---|---|---|
| 4,030,683 | 6/1977 | Eckholt | 57/58.86 X |
| 4,199,929 | 4/1980 | Vessella | 57/58.86 X |
| 4,354,343 | 10/1982 | D'Agnolo et al. | 57/58.86 X |
| 4,355,500 | 10/1982 | Yanobu et al. | 57/279 |
| 4,391,090 | 7/1983 | Charbonnier | 57/58.86 X |
| 4,405,094 | 9/1983 | Scheufeld et al. | 242/149 |
| 4,453,377 | 6/1984 | Inger et al. | 57/279 |
| 4,468,920 | 9/1984 | Lorenz | 242/149 X |

*Primary Examiner*—John Petrakes
*Attorney, Agent, or Firm*—Spensley Horn Jubas & Lubitz

[57] ABSTRACT

A tension device for use in a two-for-one twister, in which the yarn insertion is made by means of compressed air, comprises a tubular tenser body provided with a yarn passage, a tenser disposed in the tenser body and adapted to close the yarn passage at a predetermined pressure to impart a tension to the yarn, and a tenser operating member provided on a portion of the tenser body and adapted to slide within a plane perpendicular to the yarn passage.

5 Claims, 7 Drawing Figures

TENSION DEVICE FOR USE IN TWO-FOR-ONE TWISTER

This is a continuation of application Ser. No. 565,928 filed on Dec. 27, 1983, now abandoned.

BACKGROUND OF THE INVENTION

The present invention relates to a tension device for use in a two-for-one twister and, more particularly, to a tension device suitable for use in such a case that the yarn insertion is made by means of compressed air.

Generally, in a two-for-one twister, the yarn unwound from a yarn feeding bobbin carried by a stationary plate is introduced into a tension device mounted in the central bore of the bobbin and passes through the central bore of a spindle. The yarn is then fed to the outside through a radial yarn guide extending from the center of a yarn storage plate.

Thereafter, the yarn is wound over a predetermined angle around the outer peripheral surface of the yarn storage plate and rises along the wall surface and, after running from the upper end of the wall surface while drawing a balloon, the yarn is made to pass through a yarn guide above the bobbin and is taken up by a take-up package via the feed roller.

Various tension devices such as capsule tenser, ball tenser and so forth are known as the tension device for the two-for-one twister. For effecting the yarn insertion by means of compressed air, it is necessary to remove the tenser from the yarn passage and various proposals have been made to this end. These proposals, however, are unsatisfactory in the handling characteristics and the effect, and there still is a demand for improvement in such regards.

SUMMARY OF THE INVENTION

An object of the present invention is to provide an improved tension device in which a tenser can easily be separated from a yarn passage and a linear continuous yarn passage is formed when the tenser is displaced.

According to the present invention, in a tension device for use in a two-for-one twister having a tubular tenser body provided with a yarn passage through which a yarn unwound from a bobbin passes, and a tenser disposed in the tenser body and adapted to close the yarn passage at a predetermined pressure and adapted to impart a tension by the tenser to the yarn, a tenser operating member is provided on a portion of the tenser body and is adapted to slide within a plane perpendicular to the yarn passage. So, the tenser can easily be separated from the yarn passage because it is pressed by a lateral force. In addition, since the yarn passage hole of the tenser operating member is aligned with the yarn passage at the time of the separation to form a linear continuous yarn passage, the insertion of the yarn can be made in quite a smooth manner.

FIGS. *2a* and *2b* are vertical sectional views of a tension device;

FIG. *2c* is a sectional view taken along the line A—A of FIG. *2a;*

Figure 3:
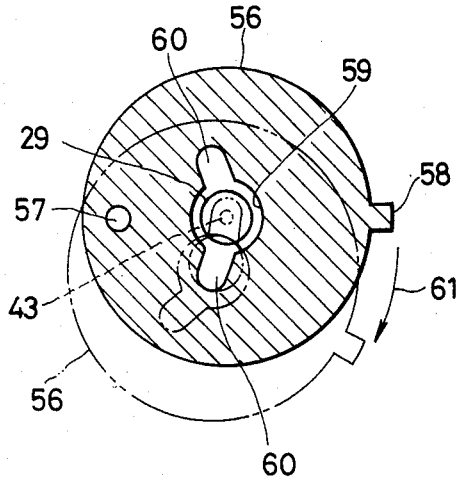

FIG. 3 is a cross-sectional view of another embodiment of the tension device, corresponding to the section shown in FIG. *2c;*

FIG. *4a* is a vertical sectional view of still another embodiment of the tension device; and FIG. *4b* is a sectional view taken along the line B—B of FIG. *4a.*

DETAILED DISCLOSURE OF THE INVENTION

A preferred embodiment of the present invention will be described hereinunder with reference to the accompanying drawings.

Figure 1:
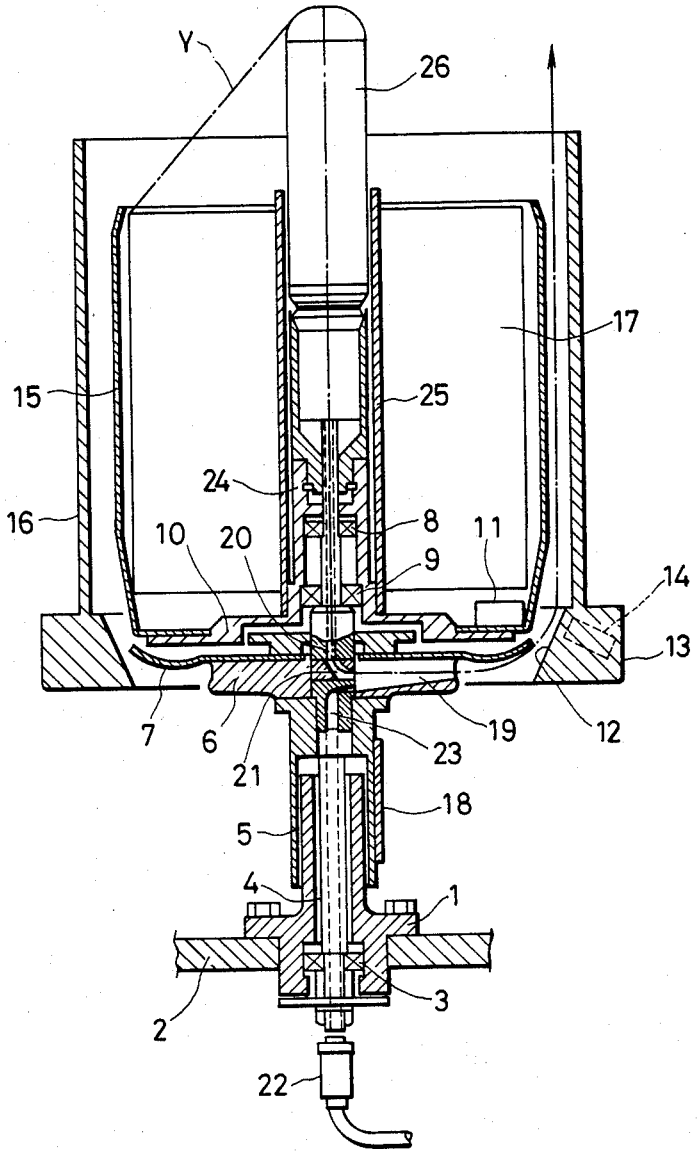
FIG. 1 is a vertical sectional view of a two-for-one twister.

FIG. 1 shows a two-for-one twister incorporating a tension device in accordance with the present invention. A reference numeral 1 designates a bearing block fixed to a spindle rail 2. A spindle 4 is rotatably supported by the bearing block 1 through a bearing 3.

A wharve 5, yarn storage plate 6 and a rotary disc 7 are unitarily fixed to the spindle 4. A stationary plate 10 is supported through bearings 8 and 9. The stationary plate 10 is fixed immovably by the mutual attracting action between the magnet 11 and a magnet 14 incorporated in an outer ring 13 having a tapered surface 12. A reference numeral 15 denotes a yarn feed cover fixed to the stationary plate 10, 16 denotes a balloon limiting cylinder fixed to the outer ring 13, and 17 denotes a yarn feeding bobbin. The outer ring 13 is fixed to the spindle rail 2 through a bracket which is not shown, while a numeral 18 denotes a belt which makes a pressure contact with the wharve 5 thereby to drive the spindle 4.

Furthermore, the yarn storage plate 6 is provided therein with a radial yarn guide tube 19 which is communicated with a yarn passage hole 20 in the center of the spindle 4 through a slant hole 21. An air duct hole 23 formed along the axis of the spindle 4 opens at its lower end towards a nozzle 22 for suplying compressed air and communicates at its upper end with the yarn guide tube 19 mentioned above.

A hollow supporting sleeve 25 is screwed to a cylindrical upper portion 24 of the stationary plate 10. A tension device 26 which will be mentioned later is fitted to the supporting sleeve 25.

The yarn Y unwound from the yarn feeding bobbin 17 is introduced into the yarn guide hole 20 in the spindle 4, through a later-mentioned yarn passage formed in the tension device 26, via an upper portion of the tension device 26. The yarn is further introduced through the slant hole 21 and the yarn guide tube 19 in the yarn storage plate 6 to the outside and is bent along the tapered surface 12 of the outer ring 13. The yarn is then pulled upwardly and then taken up or wound.

In the event of an occurence of the yarn breakage, the operator stops the rotation of the spindle 4 by the operation of a device which is not shown, and inserts the yarn end adjacent to the yarn feeding bobbin 17 into the above-mentioned yarn passage in the tension device 26 while compressed air is jetted from the nozzle 22.

The jetted compressed air is then introduced into the air passage hole 23 via to lower end of the spindle 4 and, after turned at the upper end of the hole 23, flows into the yarn guide tube 19 of the yarn storage plate 6 and then discharged to the outside. Then, by the flow of the compressed air present in the yarn guide tube 19, a sucking force acts on the yarn end in the tension device 26, so that the yarn Y is introduced into the yarn guide tube 19 from the yarn passage into the yarn guide tube 19 through the yarn guide hole 20 in the spindle 4. The yarn Y is then conveyed upwardly along a normal yarn path shown by one-dot-and-dash line. The yarn Y is then connected to the package of the yarn take-up side and the twisting operation is commenced again.

The detail of the tension device 26 will be explained hereinunder with reference to FIG. 2.

The tension device 26 has a base member 28 which engages with a supporting cylinder 25 through a rubber belt 27 and a tenser body 31 provided therein with a tenser chamber 30 accommodating a capsule tenser 29, as well as an internal spring 32.

The tenser 29 is resiliently supported by upper and lower supporting members 33 and 34. A lifting member 35 is disposed between the lower supporting member 34 and the base member 28. The lifting member 35 is fixed against rotation relative to the tenser body 31. The lifting member 35 and the base member 28 are provided with spiral groove and ridge 36 which mesh with each other.

An annular groove 37 is formed in the outer peripheral surface of the base member 28. The groove 37 is provided at a plurality of portions thereof with deep recessed 38. The recesses 38 are adapted to receive a ball 40 which is urged by the tenser body 31 through springs 39. The arrangement is such that, as the base member 28 is rotated with respect to the tenser body 31, the lifting member 35 moves up and down along the spiral groove and ridge 36, so that the resilient pressing force by the tenser 29 can be adjusted freely.

During this rotation, the ball 40 drops into successive recesses 38 so that the pressing force is adjusted in a stepped manner.

A hollow pipe 41 extends along the axes of the base member 28 and the liftable member 35. Yarn guide holes 42 and 43 are formed in the centers of the supporting members 33 and 34 so that, as the tenser 29 is removed, the yarn guide holes 42, 43, tenser chamber 30 and the hollow 44 in the pipe 41 are communicated to form the aforementioned yarn passage 45 which in turn communicates with the yarn guide hole 20 in the spindle 4 via the lower end of the hollow 44.

The opposing surfaces of the supporting members 33 and 34 constitute tapered surfaces 46 and 47 converging towards the yarn guide holes 42 and 43, so that the tenser 29 is usually located on the yarn guide holes 42, 43 while being guided by the slant surfaces 46 and 47 thereby to resiliently close these holes 42 and 43 by means of the spring 32.

Figure 2A:
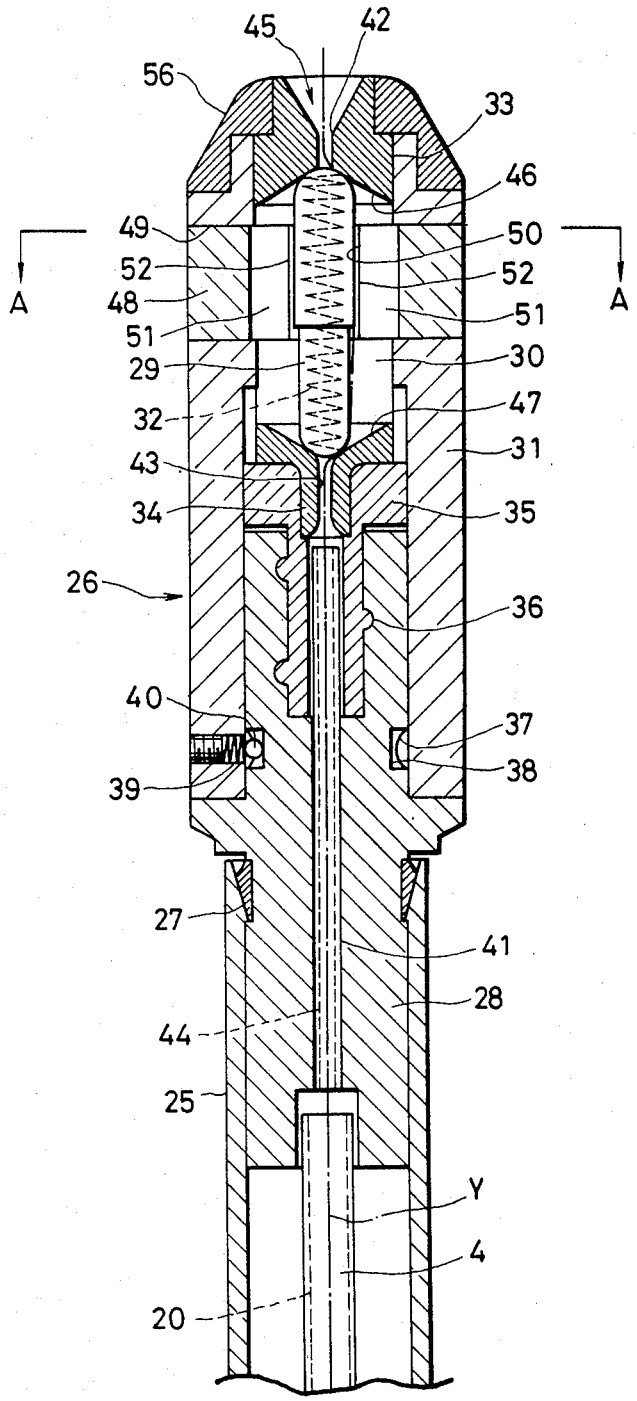

A reference numeral 48 designates a tenser operating member which is slidably received by a horizontal bore 49 formed thorugh the tenser body 31. As shown in FIG. 2*c*, the operating member 48 is provided with a tenser hole 50 capable of receiving the tenser 29 with a sufficient margin and yarn passage holes 51, 51 having U-like planar shape and communicating with the tenser hole 50. The yarn passage holes 51 and 51 are formed at both sides of the tenser hole 50 in the direction of sliding of the operating member 48. The width of the openings 52 of the yarn passage holes 51, 51 to the tenser hole 50 is selected to be smaller than the outside diameter of the tenser 29.

Figure 2B:
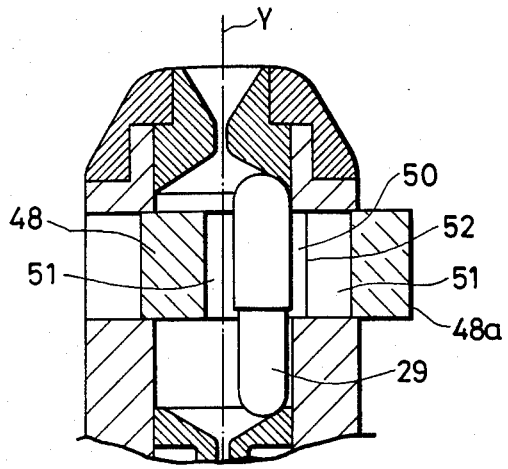
Figure 2C:
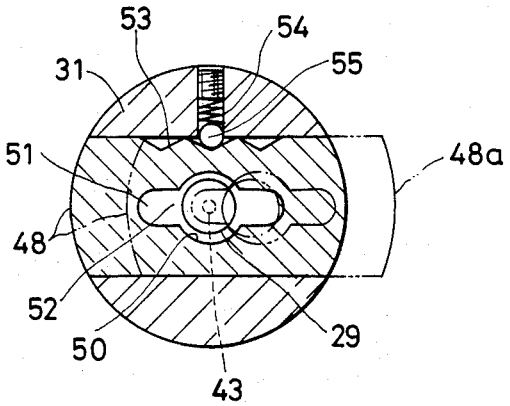

Therefore, as the tenser operating member 48 is slid laterally as shown in FIGS. 2b and 2c, one of the openings 52, 52 contacts and presses one side surface of the tenser 29 so that the tenser 29 is urged to slide towards the tenser chamber 30 along the upper and lower slant surfaces 46 and 47. The tenser chamber 30 is so sized that, as the tenser 29 comes into contact with the inner surface of the tenser body 31, the tenser 29 is perfectly separated from the yarn guide holes 42, 43. The arrangement is such that, in this state, one of the yarn passage holes 51 of the tenser operating member is located on a straight line interconnecting both yarn guide holes 42 and 43.

Therefore, after the completion of movement of the tenser 29, the yarn guide hole 42, yarn passage hole 51, tenser chamber 30, yarn guide hole 43 and the hollow 44 of the pipe 41 in combination form a continuous linear yarn passage 45.

In order to make sure of the above-mentioned movement and to prevent the operating member 48 from coming off from the tenser body 31, the tenser operating member 48 is provided with three holes 53 formed in a row in one side thereof as shown in FIG. 2*c*. These holes 53 are adapted to receive a ball 55 which is urged by the tenser body 31 through a spring 54.

When the tenser operating member 48 is in the position illustrated by full line in FIG. 2*c*, the ball 55 is received by the central one of the three holes 53, whereas, when the above-mentioned movement is completed, i.e. when the tenser operating member 48 takes the position shown by two-dot-and-dash line, the ball 55 is received by the end hole 53, so that the tenser operating member 48 is restrained from moving unexpectedly at respective positions.

The tense operating member 48 is shown in FIGS. 2*b* and 2*c* has having been moved to the right as viewed in the drawings. The foregoing explanation, however, equally applies to the case where the tenser operating member 48 has been moved to the left. For moving the tenser operating member 48 to the starting position, it can be moved back easily by lightly pressing the projecting portion 48*a* thereof.

The upper supporting member 33 is constructed as a unit with a cap 56 formed integrally with the top of the tension device 26, and the cap 56 is adapted to be screwed onto the tenser body 31 from the upper side thereof.

Therefore, the mounting of the tenser 29 is made by such a process as having the steps of inserting the tenser operating member 48 through the horizontal hole 49 to locate the same as shown in FIG. 2*a*, inserting the tenser 29 into the tenser hole 50 from the upper side, and then screwing the cap 56.

The operation of the tension device 26 explained hereinbefore is as follows. When the yarn is cut accidentally, the operator pushes the tenser operating member 48 to the position shown in FIG. 2*b* to shift the tenser 29 to a lateral side thereby to insert the yarn Y into the yarn passage 45 via the upper end of the tension device 26. As stated before, the yarn passage 45 is opened in a straight form as stated before, so that the yarn can be introduced without substantial difficulty. Thereafter, the yarn Y is pulled upwardly from the yarn passage 45 through the yarn guide hole 20, slant hole 21 and the yarn guide tube 19 thereby to complete the yarn insertion.

The yarn Y is attracted by the sucking action of the compressed air, so that the force for pulling the yarn is rather small as compared with the case where, for example, the compressed air is directed into the yarn passage 45 via the upper end of the tension device 46. However, the yarn insertion explained above can be accomplished rationally because the path between the yarn passage 45 and the outlet of the yarn guide hole 20 opens linearly.

After the completion of the operation, the operator pushes the projection 48*a* of the tenser operating member 48 to reset the operating member to the starting position so that the tenser 29 is reset to commence the taking up of the yarn. In this state, the yarn Y in the yarn passage hole 51 of the tenser operating member 48 is moved into the tenser chamber 50 through the opening 52 and is pulled out downwardly under a suitable tension which is given by the cooperation between the tenser 29 and the upper and lower supporting members 33 and 34.

FIG. 3 shows another embodiment of the tension device of the invention, in which the same reference numerals are used to denote the same parts or members as those used in FIG. 2. In this Figure, a reference numeral 56 denotes a tenser operating member corresponding to the tenser operating member 48 explained in connection with FIG. 2, which, in this case, has a cylindrical form. This tenser operating member 48 is disposed at the same side as that shown in FIG. 2*a*.

The tenser operating member 56 is rotatably supported by a pin 57 which is projected from the tenser body 31. A projection 58 for facilitating the manual operation is disposed at the opposite side to the pin 57.

The central tenser hole 59 is identical to that shown in FIG. 2, while the yarn passage holes 60, 60 formed at both sides of the latter have arcuate forms centered at the pin 57.

As the tenser operating member 56 is rotated in the direction of the arrow by a finger touching at the projection 58, the tenser 29 is moved to the position illustrated by two-dot-and-dash line, while the yarn passage hole 60 is positioned above the yarn guide hole 43, thereby to form a linear yarn passage.

Figure 4A:
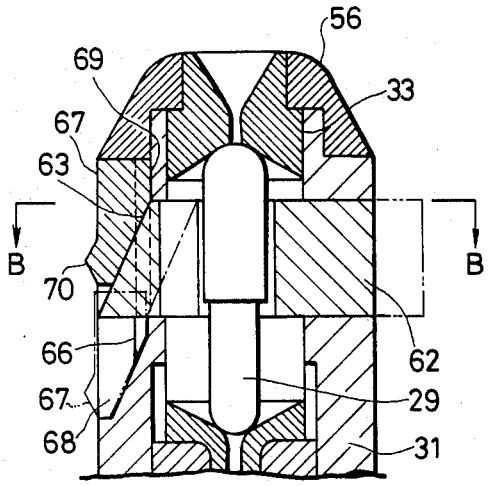

FIG. 4 shows still another embodiment of the invention. In this Figure, a reference numeral 62 designates a tenser operating member which is provided at its one end with a slant surface 63 and urged to the left as viewed in the drawings by a spring 64 which is disposed between the tenser operating member itself and the tenser body 31. The tenser operating member 62 has the yarn passage hole 65 only on one side thereof adjacent to the slant surface 63. An operating piece 67 fitting the tenser body 31 through vertical convexity and concavity 66 formed on their joint surfaces makes a surface contact with the slant surface 63. A notch 68 capable of receiving the most part of the operating piece 67 is formed in the portion of the tenser body 31 below the operating piece 67. The arrangement is such that, when the tenser operating member 62 is slid to the right and the operating piece 67 is moved downward along the convexity and concavity 66 into the recess 68, the vertical portion 69 of the operating piece 67 slightly projects above the recess 68.

A reference numeral 70 designates a projection for lifting the operating piece 67 up and down by means of a finger. In mounting the tenser 29, the tenser operating member 62 is inserted from the left side as viewed in the drawings overcoming the force of the spring 64 and then the operating piece 67 is slided along the convexity and concavity 66 from the upper side, and finally the supporting member 33 and the cap 56 are screwed.

For the insertion of the yarn, the operating piece 67 is pressed down at once into the recess 68 by a finger which is retained at the projection 70. In this state, the tenser operating member 62 is pressed at its slant surface 63 rightwardly by the operating piece 67 so as to be moved to the position shown by two-dot-and-dash line overcoming the force of the spring 64.

When the operating piece 67 has reached substantially the lower end of the recess 68, the vertical portion 69 projected slightly above the recess 68 is contacted by the lower end of the slant surface 63 of the tenser operating member 62, so that the tenser operating member 62 is stopped and held at the position shown by two-dot-and-dash line.

Figure 4B:
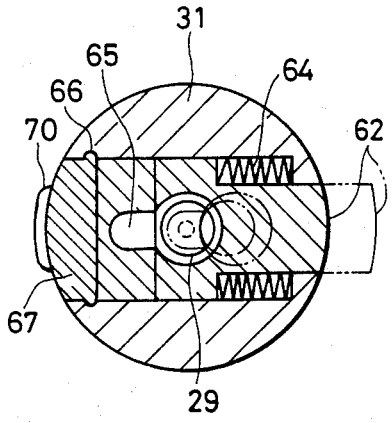

In this state, the tenser 29 has been removed from the yarn guide hole 43 and the yarn passage hole 65 is positioned on the yarn guide hole 43 as shown in FIG. 4*b*.

After the completion of the yarn insertion, as the projection 67 is lightly springed up by a finger, the lower end of the slant surface 63 is easily disengaged from the vertical portion 69 and the slant surface 63 urges the operating piece 67 upwardly by the force of the spring 64 to the starting position shown by full line.

The tenser 29 employed by each embodiment explained hereinbefore may be a ball tenser.

What is claimed is:

1. A tensioning device for use in a yarn twisting apparatus for applying a tension force to yarn fed through said apparatus; said tensioning device having a yarn inlet opening, a yarn outlet opening and a chamber between said inlet and outlet openings; a tensioning member disposed in said chamber between said inlet and outlet openings; and manually-operable means for moving said tensioning member between a tensioning position wherein said tensioning member applies a tensioning force to yarn passing through said tensioning device and a retracted position wherein said tensioning member permits unrestricted passage of yarn through said tensioning device, wherein the manually-operable means includes a fixing means for independently holding the tensioning member in either the tensioning position or the retracted position.

2. A yarn twisting apparatus comprising: a tensioning device for applying a tension force to yarn passing through said apparatus; said tensioning device including a yarn inlet opening, a yarn outlet opening and a chamber between said inlet and outlet opening; a source of suction at the outlet opening side of said tensioning device for applying a suction force to yarn to be drawn through said tensioning device; a tensioning member disposed in said chamber of said tensioning device between said inlet and outlet openings; and manually-operable means for moving said tensioning member between a tensioning position wherein said tensioning member applies a tensioning force to yarn passing through said tensioning device and a retracted position wherein said tensioning member permits unrestricted passage of yarn through said tensioning device and wherein the manually-operable means includes a fixing means for independently holding the manually-operable means in either the tensioning position or retracted position.

3. A device according to claim 1 or 2, wherein said tensioning device further includes a transverse slot extending across said chamber; and wherein said manually-operable means for moving said tensioning member between its tensioning position and its retracted position is rotatably supported for transverse movement in said slot.

4. A device according to claim 1 or 2, wherein said manually-operable means for moving said tensioning member includes a central opening through which yarn is adapted to pass when said tensioning member is in its tensioning position, and an auxiliary opening through which yarn is adapted to pass when said tensioning member is in its retracted position.

5. A tensioning device for use in a yarn twisting apparatus for applying a tension force to yarn fed through said apparatus; said tensioning device having a yarn inlet opening, a yarn outlet opening and a chamber between said inlet and outlet openings; a tensioning member disposed in said chamber between said inlet and outlet openings; and manually-operable means for moving said tensioning member between a tensioning position wherein said tensioning member applies a tensioning force to yarn passing through said tensioning device and a retracted position wherein said tensioning member permits unrestricted passage of yarn through said tensioning device; wherein said manually-operable member includes a slant surface at one end thereof; said manually-operable member having a central hole for receiving said tensioning member; said manually operable member having an auxiliary hole located on one side of said central hole adjacent to said slant surface; springs for urging said manually-operable member in a direction toward said slant surface; and an operating member having a slant surface for contacting said slant surface of said manually-operable member; said operating member having a manually accessible structure; and a notch for receiving said manually accessible structure.

* * * * *